US008979096B2

(12) United States Patent
Tillis et al.

(10) Patent No.: US 8,979,096 B2
(45) Date of Patent: Mar. 17, 2015

(54) INLINE SKATES TRAINING DEVICE

(71) Applicants: Amir J. Tillis, Oak Park, IL (US); Troy W. Livingston, Northbrook, IL (US); Greg Dempsey, Glen Ellyn, IL (US)

(72) Inventors: Amir J. Tillis, Oak Park, IL (US); Troy W. Livingston, Northbrook, IL (US); Greg Dempsey, Glen Ellyn, IL (US)

(73) Assignee: Valerie Bates, Oak Park, IL (US)

( * ) Notice: Subject to any disclaimer, the term of this patent is extended or adjusted under 35 U.S.C. 154(b) by 0 days.

(21) Appl. No.: 13/921,601

(22) Filed: Jun. 19, 2013

(65) Prior Publication Data

US 2013/0334779 A1 Dec. 19, 2013

Related U.S. Application Data

(60) Provisional application No. 61/661,450, filed on Jun. 19, 2012.

(51) Int. Cl.

| | |
|---|---|
| ***A63C 17/14*** | (2006.01) |
| ***A63C 17/00*** | (2006.01) |
| *A63C 17/06* | (2006.01) |

(52) U.S. Cl.

CPC ..... *A63C 17/0073* (2013.01); *A63C 17/004* (2013.01); *A63C 17/06* (2013.01)

USPC ..... 280/11.206; 280/11.211

(58) Field of Classification Search

CPC .. A63C 17/004; A63C 17/0073; A63C 17/14; A63C 17/1409; A63C 17/1427; A63C 17/1436; A63C 17/1445

USPC ..... 280/11.204, 11.205, 11.206, 11.208, 280/11.211, 11.215, 11.216, 11.223, 11.27, 280/11.28

(56) References Cited

U.S. PATENT DOCUMENTS

| | | | | | |
|---|---|---|---|---|---|
| 2,450,979 | A | * | 10/1948 | Moller | 280/293 |
| 5,088,748 | A | * | 2/1992 | Koselka et al. | 280/11.206 |
| 5,183,276 | A | | 2/1993 | Pratt | |
| 5,478,094 | A | * | 12/1995 | Pennestri | 280/11.207 |
| 5,486,011 | A | * | 1/1996 | Nelson | 280/11.207 |
| 5,551,711 | A | | 9/1996 | Mangelsdorf | |
| 5,813,678 | A | * | 9/1998 | Robins | 280/11.204 |
| 6,039,328 | A | * | 3/2000 | Pawlowski et al. | 280/7.13 |
| 6,047,973 | A | * | 4/2000 | Amore et al. | 280/11.209 |
| 6,422,578 | B1 | | 7/2002 | Oh | |
| 6,467,777 | B2 | * | 10/2002 | Teyhen | 280/11.115 |
| 7,523,948 | B1 | | 4/2009 | Wright | |
| 2008/0164666 | A1 | | 7/2008 | Lioce | |

FOREIGN PATENT DOCUMENTS

| | | |
|---|---|---|
| EP | 0841081 | 5/1998 |

* cited by examiner

*Primary Examiner* — Frank Vanaman

(74) *Attorney, Agent, or Firm* — Boyle Fredrickson, S.C.

(57) ABSTRACT

A training device for inline roller skates includes a training wheel bracket, a training wheel mounted upon the bracket, and means for adjustably mounting the device upon the inline skate. The training wheel is adapted to engage upon the travel surface to compensate for any unbalance of the trainee and to enable the trainee to travel in a desired direction. The training wheel is adapted to provide a braking action to the roller wheels if the trainee loses balance or the trainee's ankle collapses. The training device serves the dual purpose of providing a means of balancing the skater as well as slowing and braking the forward movement of the skater to control and limit the speed of the skater.

19 Claims, 5 Drawing Sheets

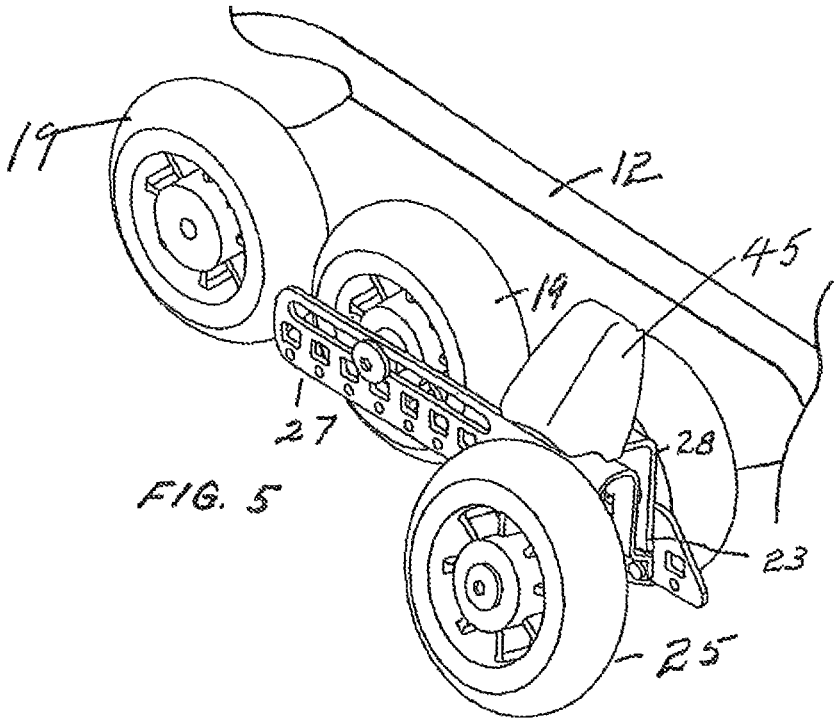
FIG. 5
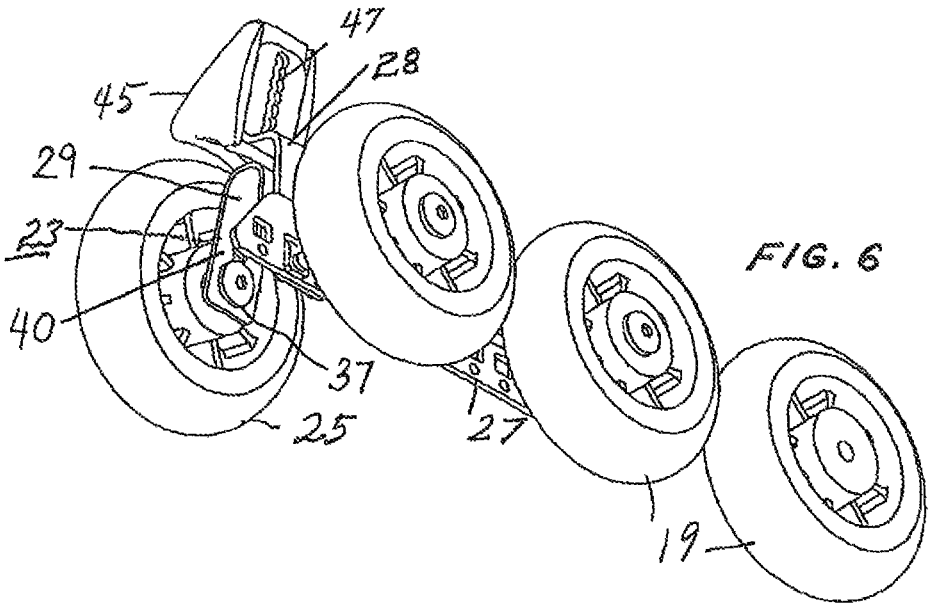
FIG. 6
FIG. 7
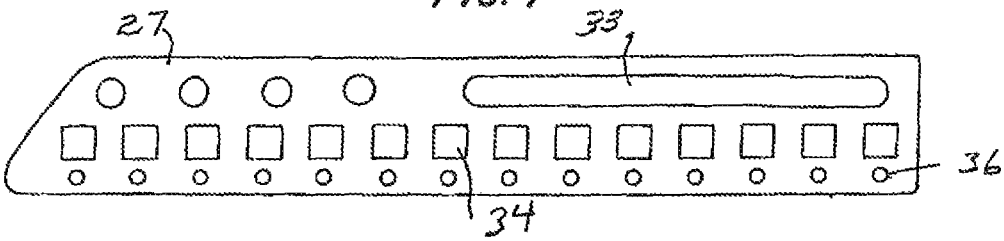

INLINE SKATES TRAINING DEVICE

CROSS-REFERENCE TO RELATED APPLICATIONS

This application claims the benefit of U.S. provisional patent application Ser. No. 61/661,450 filed Jun. 19, 2012, the entirety of which is hereby expressly incorporated by reference.

BACKGROUND OF THE INVENTION

Inline skates, which are commonly known in the an, have two or more wheels arranged in a single straight line. Inline skates are often referred to as "Rollerblades®" after the popular brand name. Unlike quad skates which have two front and two rear wheels, inline skates have the aforesaid single straight line of wheels which makes learning the art of inline skating, including the skill of braking the forward or backward movement of the rolling wheels, more complex. The foregoing is due to the fact that typical recreational inline skates have a stop or brake (e.g., friction bar/pad) at the back end of the skate which is forced down to engage the travel surface in order to brake/stop forward or backward movement of the skate.

Accordingly, a person (i.e., trainee) attempting to learn to skate using skates having inline/tandem roller wheels wherein the roller wheels are mounted in a straight line must initially master two skills, namely the art of balancing on the single line of roller wheels and the art of braking. A trainee typically overcorrects for any front-to-back unbalance condition and causes the roller wheels to move uncontrollably until the trainee person hills down. Compounding this front-to-hack motion problem is the tendency for the inexperienced trainee to have his/her ankles bow-in or bow-out, thereby causing loss of control of the skates and risking potential ankle injury. The trainee must also master the ability to controllably stop or brake his/her forward or backward motion. As mentioned above, the typical inline skate has a brake pad installed in the heel of the skate, and to engage this brake pad a person's weight must be balanced on one in-line skate while the other in-line skate is tipped up at the front while pushing down at the heel to engage the brake pad. The aforementioned balancing and braking skills take some practice to learn.

Accordingly, it is the purpose and object of the present invention to provide an improved device for learning the skills of balancing and braking control on in-line skates. The present invention makes the process of mastering the art of inline skating easier and safer, and importantly reduces the risk of injury.

SUMMARY OF THE INVENTION

It is an object of the present invention to provide a training device for an inline/tandem wheel roller skate including a training wheel device for use with said skate. Typical inline roller skates have a series of wheels mounted in a single straight line. The training wheel device of the invention comprises a training wheel bracket, a training wheel mounted on the bracket and axially spaced from the series of wheels, and a means for mounting the device upon the tandem roller skate. The training wheel is adapted to engage the ground at a spaced position from the series of wheels to compensate for any unbalance of the trainee, and to thus enable the trainee to travel in a desired direction. Further, the training wheel is adapted to provide a braking action to the roller wheels if the trainee loses balance or the trainee's ankle collapses. The described structure thus serves the dual purpose of providing a means for balancing the skater as well as slowing and braking the forward movement of the skater to control and limit the speed of the skater. This provides two important learning and safety features.

In accordance with one aspect of the present invention, a training device for an inline roller skate has a bracket for mounting onto the axle of a skate wheel. A training wheel is coupled to the bracket whereby the training wheel does not touch the ground when the skate wheel is substantially vertical indicating a balanced condition, but touches the ground when the skate wheel becomes tilted indicating an unbalanced condition. The training device further includes a brake pad which is coupled to the bracket and contacts the top edge of the training wheel when the skate wheel is tilted to a predetermined angle in order to slow the motion of the skate wheels.

In one embodiment, the training device has a U-shaped member which is mounted to the skate wheel and the training wheel. A flexible pad is located between the U-shaped member and the bracket, wherein the flexible pad is compressed when the skate wheel is titled to a predetermined angle. When the flexible pad is compressed, the skate wheel contacts the brake pad, causing the skate wheel to brake.

In one embodiment, the flexible pad has a durometer hardness rating of 30 A to 40 A.

In one embodiment, the brake pad is made of a rubber having a durometer hardness of substantially 70 A.

The invention contemplates that the training device may be mounted to the inner or outer side of the inline roller skate.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof and the invention includes all such modifications.

BRIEF DESCRIPTION OF THE DRAWINGS

The drawings illustrate the best mode presently contemplated of carrying out the invention. In the drawings:

FIG. 5 is an isometric view of the training device of the invention showing the inventive device mounted on an inline skate;

FIG. 6 is an isometric view showing the opposite side relative to FIG. 5 of the training device;

FIG. 7 is a side view of the mounting bracket of the training device;

Figure 1:
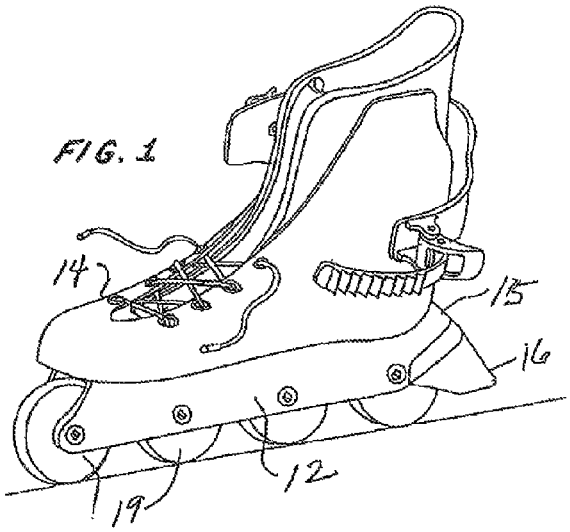
FIG. 1 is an isometric view of a typical inline skate.

In describing the embodiments of the invention which are illustrated in the drawings, specific terminology will be resorted to for the sake of clarity. However, it is not intended that the invention be limited to the specific terms so selected and it is understood that each specific term includes all technical equivalents which operate in a similar manner to accomplish a similar purpose. For example, the word "connected," "attached," or terms similar thereto are often used. They are not limited to direct connection but include connection through other elements where such connection is recognized as being equivalent by those skilled in the art.

DETAILED DESCRIPTION

FIG. 1 is a showing of a typical recreational inline skate 15 having an elongated wheel frame 12 mounted beneath a boot 14. A series of rotatable wheels 19 are mounted in a single straight line and disposed partially within wheel frame 12 and extending downwardly therefrom. A brake leg 16 projects downwardly from the back end of frame 12.

Figure 2:
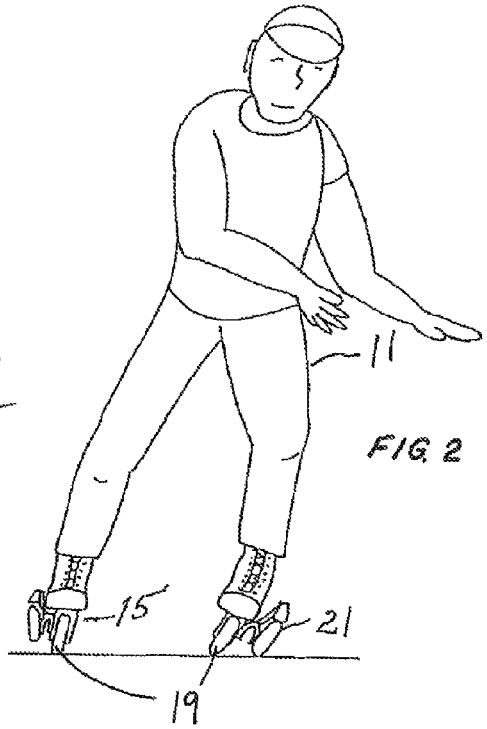
FIG. 2 is a pictorial view showing the inventive device mounted on a pair of inline skates and showing the tendency of a trainee in-line skater to become unbalanced with his/her ankles turning outwardly, and illustrating the training device of the present invention mounted outboard of the wheels of the inline skate.

As previously mentioned, FIG. 2 depicts a first typical tendency of a novice inline skater 11 supported on inline skates 15 in which he/she becomes unbalanced due to the fact that his/her ankles turn-out relative to the running line of the skate's tandem/inline mounted wheels, generally labeled as 19. For controlling this tendency, the inventive training device 21 is mounted to the outer side of skate 15.

Figure 3:
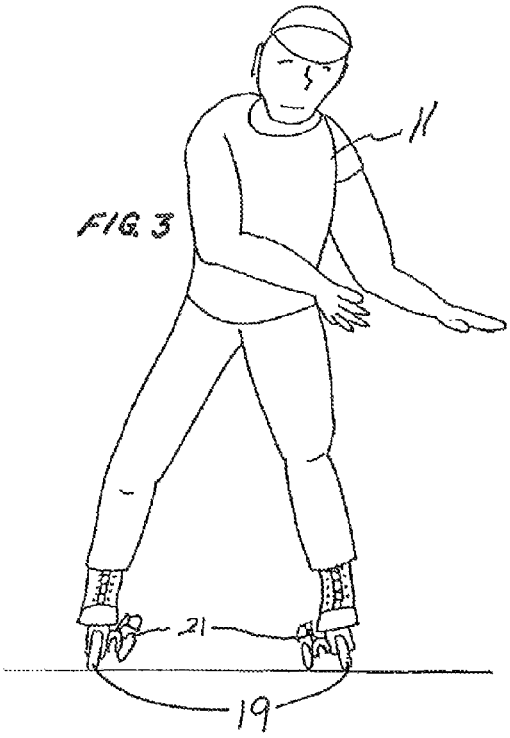
FIG. 3 is a pictorial view showing similar to FIG. 2 showing the tendency for his/her ankles to turn inwardly, and illustrating the training device of the present invention mounted inboard of the wheels of the inline skate.

FIG. 3 depicts a second typical tendency of the ankles of a novice skater 11 in which the ankles turn-in. For controlling this latter tendency, the training device 21 is mounted on the inner side of the foot. It is contemplated that the training device 21 may be mounted to one or both sides of skate 15.

Figure 4:
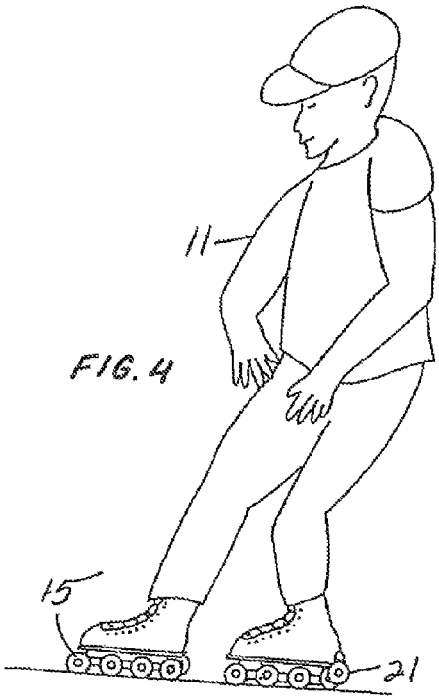
FIG. 4 is a pictorial view of the inventive device mounted on a pair of inline skates and showing that the inventive device will not hinder the forward motion of a skater when the skater is moving forward or backward in a balanced mode.

FIG. 4 shows that the training device 21 will not hinder forward or backward movement of the skate 15 when the skater is in a balance posture because the training device 21 does not make physical contact with the ground.

Referring now to FIGS. 5 and 6, importantly, the present inventive device 21 has been constructed to be retrofittable on most typical recreational inline skates that are sold on the market. Further, the inventive device 21 may conveniently be temporarily secured and affixed to an inline skate 15. For example, device 21 may be mounted on skates 15, utilized during the training/learning process, and then readily removed from the skate 15 when the training/learning process is completed.

Figure 8:
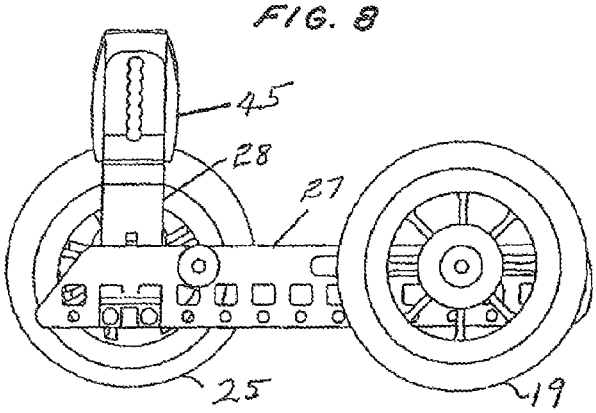
FIG. 8 is a side view of the training device to depict the adjustability of the mounting bracket.
Figure 9:
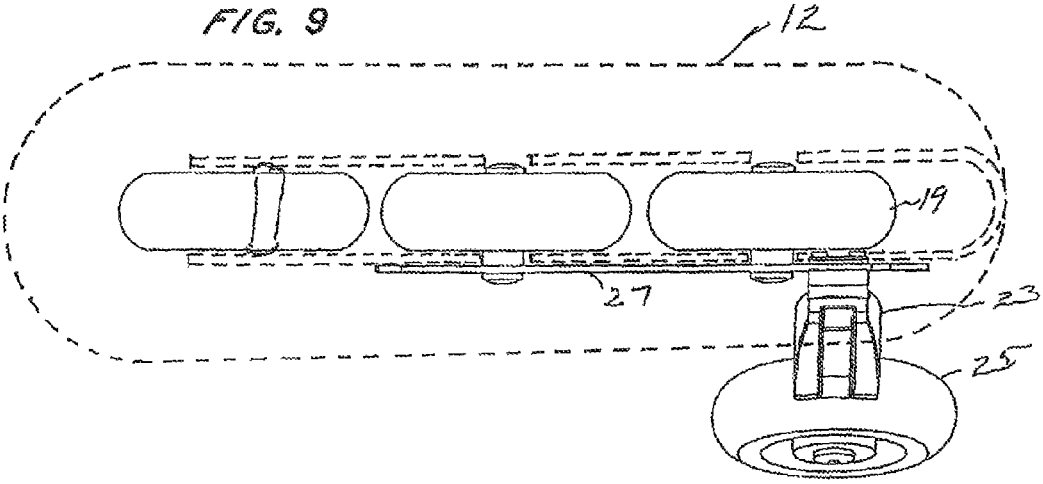
FIG. 9 is a top view of a graphic dotted outline of an inline skate to show the outboard positioning of the training wheel.

As shown in FIG. 5, the device 21 includes a bracket assembly 23 on which an outboard/training wheel 25 is mounted outside the running line of the inline wheels 19. The outboard/training wheel 25 is attached to the skate by a number of adjustable brackets 27, 28 and 29. Training wheel 25 may be of the same diameter and width as the inline wheels 19 or may take any diameter and width desired. Bracket 27 is representatively in the form of a perforated, generally rectangular bar that is suitably mounted on the axles 31 of two wheels 19, see also FIGS. 7 and 8. However, it is contemplated that the bracket 27 may be mounted on any number of wheels 19, including one or more wheels. An elongated slot 33 in bar 27 which is affixed to skate frame 12 by a suitable bolt or pin enables horizontal adjustment of the bar 27. That is, the bar 27 can universally adapt to various sized skate frames 12, and thus, can attach to wheel 25 as required by adapting to the size of the skate 15. The bracket 28 is representatively in the form of a vertically extending bar that includes hooks that engage and lock into rectangular slots 34 in bracket 27 (somewhat similar to a known pegboard). A plurality of slots 34 and 36 are provided for the purpose of enabling convenient horizontal adjustment of assembly 23, as will be further described. FIG. 9 shows the positioning of the training wheel 25 with respect to the skate wheel 19 and the skate frame 12.

A brake pad 45 is affixed on the distal end of the bracket 28 in vertically oriented slots 47. The height of brake pad 45 may be adjusted vertically along slots 47. Brake pad 45 provides a friction stopping force to the training wheel 25 when the wheel moves into contact with the brake pad 45 as will be described below. The third bracket 29 is generally an inverted U-shape bracket and includes an aperture 37 at the open end of an outer leg 40 of bracket 29 for mounting the axle 38 of the training wheel 25, see FIGS. 6 and 10A. The other or inner leg 41 of U-shaped bracket 29 is suitably fastened to bracket 27. A flexible bushing/pad 39 is mounted between the inner leg 41 of bracket 29 and the bracket 28. Bracket assembly 23 enables the changing of the position of the outboard wheel as the trainee's skill level progresses as will be further explained.

In an alternative embodiment, third bracket 29 may be a flexible spring material, such as a round helical wire, which is affixed to axle 38 of training wheel 25 and is compressed between training wheel 25 and wheel 19 when wheel 19 is tilted. When the flexible spring material is compressed, training wheel 25 is pivoted to contact brake pad 45. A bushing/pad 29 may be mounted between the flexible spring material and the bracket 28. Compression of bushing/pad 39 helps to facilitate contact of training wheel 25 with brake pad 45, as will be further explained.

Figure 10A:
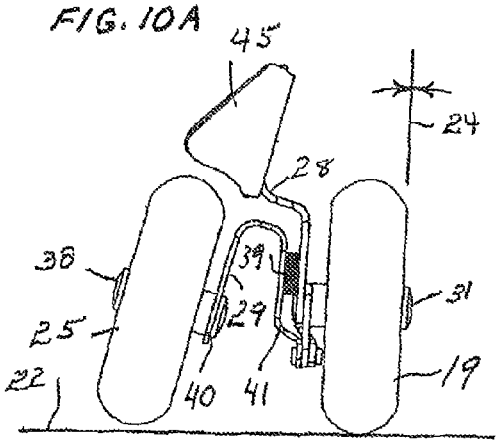
FIGS. 10A, 10B, 10C and 10D depict, in combination and by comparison to each other, the balancing and braking action of the inventive training device.
Figure 10B:
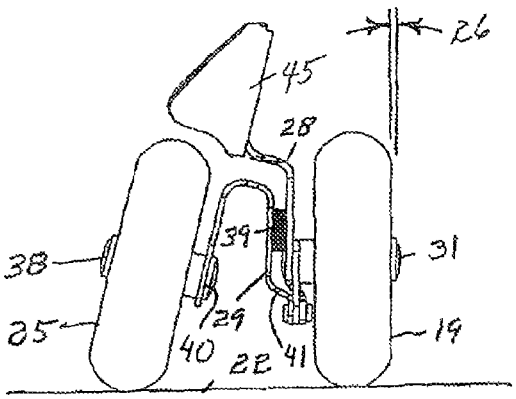
Figure 10C:
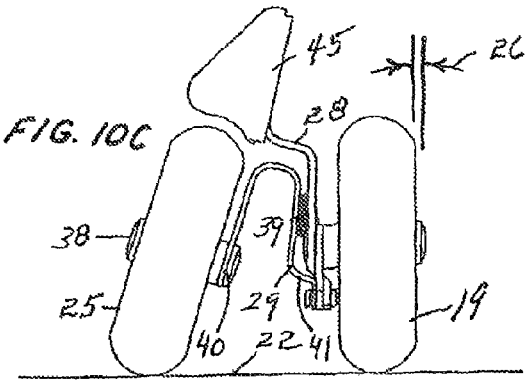
Figure 10D:
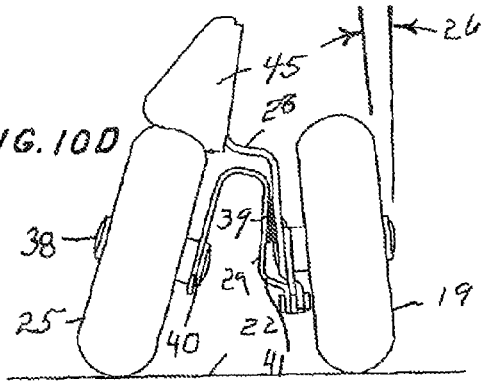

FIGS. 10A, 10B, 10C and 10D depict operation of the training device 21. As shown in FIG. 10A, in a balanced mode, training wheel 25 does not touch the ground surface 22 (i.e., the running surface over which the wheels 19 are traveling), that is, the bracket assembly 23 is in a passive non-functional mode. The skate wheels 19 essentially move in a balanced vertical orientation as depicted by line 24. FIG. 10B depicts the position of the training wheel 25 as the skate starts to become unbalanced (e.g., tilt toward the left) as indicated by the small acute angle 26 in FIG. 10B, in this view, the training wheel 25 provides a modicum of support to balance the skate 15 via axle 31. FIG. 10C depicts the position of the wheel 25 as the skate becomes more unbalanced (tilted). In this mode the wheel 25 presses more forcefully against running surface 22. The inverted U-shaped bracket 29 affixed to axle 38 of training wheel 25 compresses the flexible pad 39 to oppose the tilting of the wheel 19 and to maintain the wheel 19 in an upright position. FIG. 10D depicts the position of the training device 21 and the bracket assembly 23 when the unbalance and tilting condition becomes more extreme, as shown by the large angle 26 of the tilt of wheel 19. In this mode shown in FIG. 10D, the tilting action of wheel 19 and the resistance of training wheel 25 against running surface 22 cause the flexible pad 39 to fully compress thereby causing brake pad 45 to engage the upper periphery of training wheel 25 and frictionally cause wheel 25 to drag on the running surface and to slow down or stop the forward motion of the skate 15. That is, as the unbalance or tilting becomes too great, the forward motion of the skate is stopped by the dragging of wheel 25 on the running surface 22, while concurrently limiting the further tilting of the skate 15 and wheel 19.

In operation, the flexible/compressible pad 39 is compressed as the skate 15 and user's ankle bend toward the left as shown in FIG. 10B-10D. Pad 39 may be formed of thirty to forty durometer hardness rubber and compress to approximately sixty percent of its original thickness. The flexibility/durometer rating of the bushing/pad 39 is selectable dependent on the size of the skate and/or weight of the user.

Figure 11A:
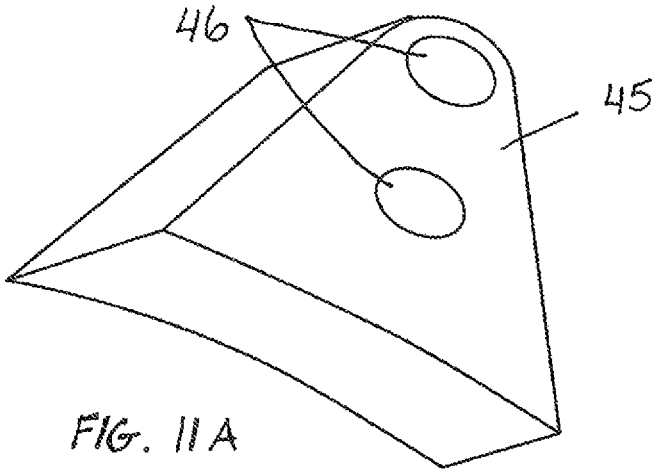
FIGS. 11A and 11B depict an isometric view and side view, respectively, of an alternative embodiment of the brake pad of the training device.
Figure 11B:
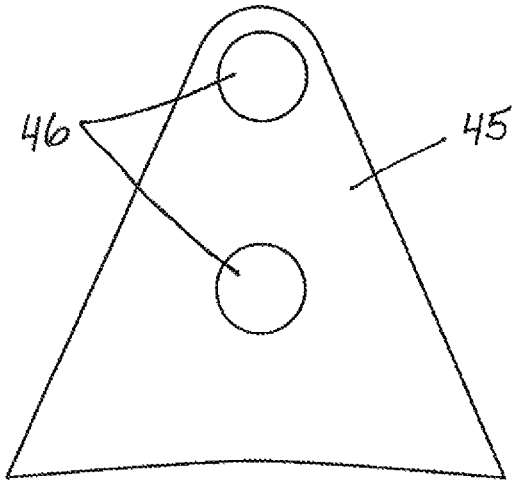

As the skate is moved to the left (and the ankle bends) the pad 39 is progressively compressed, as depicted in the progression of FIGS. 10C and 10D. This action causes the brake pad 45 to contact the upper periphery of wheel 25 and tend to slow down or stop wheel 25. The more the skate 15 tilts to the left, the greater the friction force to stop the rotation of wheel 15. Brake pad 45 may be formed to substantially seventy durometer hardness rubber. The flexibility/durometer rating of the brake pad 45 is also selectable dependent on the size of the skate and/or weight of the user. Referring to FIGS. 11A and 11B, in an alternative embodiment, the brake pad 45 may be constructed in a generally triangular prism shape and may contain a plurality of through holes 46 for fixing the brake pad 45 to bracket 28 with a bolt or pin and preventing unwanted rotation of the brake pad 45.

The training device 21, including the bracket assembly 23, may be designed, manufactured, and sold for two categories of skaters, e.g., a first category for skaters weighing up to a certain weight limit, such as eighty pounds, and a second category designed for skaters weighing above the weight limit, such as between eighty pounds and two hundred and fifty pounds, so that the appropriate materials for the training device 21 may be selected, e.g., material for the flexible bushing/pad 39 and the brake pad 45.

Operational adjustments to the training device 21 can be made as follows. A first adjustment for the skate is the positioning of the height of the training wheel 23. Referring to FIGS. 5 and 6, at early stages of training, the training wheel 23 will be positioned and adjusted to engage the ground at very small tipping angles of the inline skate to provide a maximum amount of ankle support. As more skill is attained in keeping the inline skates vertical and controlling the tipping angle for making turns, the training wheels can be adjusted higher to allow for more advanced maneuvers.

A second adjustment may be made for controlling the force required on the training wheel to engage the training wheel braking system. Early stage trainees can adjust the braking system to be engaged at very slight pressures on the training wheels. As the trainee's skill level improves, the braking system can be incrementally adjusted to allow for more aggressive turning maneuvers before the braking device will automatically engage. These two adjustments are independent and can be made to customize the inline skate to the trainee's initial physical ankle strength and balancing skill. Incremental adjustments can then be made as the trainee's skill level improves in tipping and balance.

The bracket assembly enables the training wheel 25 to be attached to a preexisting inline wheel assembly and the inline skate by extension bolts utilizing the existing axle bolts of the wheels. The same set of training wheels can therefore be used for most shoe sizes of roller blades. It is contemplated that the assembly may be interchangeable and can be mounted on either the right or left foot skate, and further may be mounted on the interior or exterior side of a skate.

The training wheels require no maintenance or service beyond the normal cleaning and wheel mounting bolt tightening required per a typical roller blade. The components may be made of corrosion proof materials ensuring many years of use and storage with minimal difficulty in transferring form one set of roller blades to another.

While the invention has been particularly shown and described with reference to preferred embodiments thereof, it will be understood by those skilled in the art that various changes in form and details may be made therein without departing from the spirit and scope of the invention.

We claim:

1. A training device for an inline roller skate having at least two skate wheels mounted in a straight line comprising:

a bracket for mounting onto an axle of at least one of the skate wheels;

a training wheel coupled to the bracket wherein the training wheel is spaced laterally from the skate wheels when the bracket is mounted onto the axle of at least one of the skate wheels; and a brake pad coupled to the bracket, wherein the brake pad is spaced laterally from the skate wheels and above the training wheel when the bracket is mounted onto the axle of at least one of the skate wheels;

wherein when the training device is secured to the inline roller skate by mounting the bracket onto at least one of the skate wheels, the training wheel and the brake pad are arranged such that the training wheel contacts an underlying ground surface without contacting the brake pad when the skate wheels are oriented at less than a predetermined angle relative to a vertical position, and wherein, when the skate wheel is moved to the predetermined angle relative to the vertical position by angular movement of the skate in use, the brake pad is selectively contacted by the training wheel while the training wheel and the bracket remain in a predetermined position relative to each other and while both the training wheel and the skate wheels are in contact with the underlying ground surface, so as to slow rotation of both the training wheels and the skate wheels while both the training wheel and the skate wheels remain in contact with the underlying ground surface.

2. The training device of claim 1 further comprising a U-shaped member having an outer leg and an inner leg wherein the inner leg is mounted to the skate wheel and the outer leg is mounted to the training wheel.

3. The training device of claim 1 wherein the bracket is mounted inwardly of the inline roller skate.

4. The training device of claim 1 wherein the bracket is mounted outwardly of the inline roller skate.

5. The training device of claim 1 wherein the bracket is mounted on the axle of each of two skate wheels.

6. The training device of claim 1 wherein the bracket may be adjustably mounted to the at least one skate wheel.

7. The training device of claim 1 wherein the height of the training wheel is adjustable.

8. The training device of claim 1 wherein the height of the brake pad is adjustable.

9. A training device for an inline roller skate having at east two too skate wheels mounted in a straight line comprising:

a bracket for mounting onto an axle of at least one of the skate wheels;

a training wheel coupled to the bracket wherein the training wheel is spaced laterally from the skate wheels when the bracket is mounted onto the axle of at least one of the skate wheels;

an inverted U-shaped member having an outer leg and an inner leg wherein the inner leg is interconnected with the bracket and the outer leg is mounted to the training wheel;

a brake pad coupled to the bracket wherein a top edge of the training wheel selectively contacts the brake pad when a predetermined angle is achieved by the skate wheel with respect to a vertical position; and a flexible pad positioned between the inner leg of the inverted U-shaped member and the bracket, wherein the flexible pad is compressed when the skate wheel is moved away from a vertical position causing the training wheel to contact the brake pad.

10. An inline roller skate training device comprising:

an inline roller skate having at least two skate wheels mounted in a straight line;

a bracket for mounting onto an axle of at least one of the skate wheels;

a training wheel coupled to the bracket wherein the training wheel is spaced laterally from the skate wheels when the bracket is mounted onto the axle of at least one of the skate wheels; and a brake pad coupled to the bracket wherein the brake pad is spaced laterally from the skate wheels and above the training wheel;

wherein the training wheel and the brake pad are arranged such that the training wheel contacts an underlying ground surface without contacting the brake pad when the skate wheels are oriented at less than a predetermined angle relative to a vertical position, and wherein, when the skate wheel is moved to the predetermined angle relative to the vertical position by angular movement of the skate in use, the brake pad is selectively contacted by the training wheel while the training wheel and the bracket remain in a predetermined position relative to each other and while both the training wheel and the skate wheels are in contact with the underlying ground surface, so as to slow rotation of both the training wheels and the skate wheels while both the training wheel and the skate wheels remain in contact with the underlying ground surface.

11. The training device of claim 10 further comprising a U-shaped member having an outer leg and an inner leg wherein the inner leg is mounted to the skate wheel and the outer leg is mounted to the training wheel.

12. The training device of claim 10 wherein the bracket may be adjustably mounted to the at least one skate wheel.

13. An inline roller skate training device comprising:

an inline roller skate having at least two skate wheels mounted in a straight line;

a bracket for mounting onto an axle of at least one of the skate wheels;

a training wheel coupled to the bracket wherein the training wheel is spaced laterally from the skate wheels when the bracket is mounted onto the axle of at least one of the skate wheels;

an inverted U-shaped member having an outer leg and an inner leg wherein the inner leg is mounted to the skate wheel and the outer leg is mounted to the training wheel;

a brake pad coupled to the bracket wherein a top edge of the training wheel selectively contacts the brake pad when a predetermined angle is achieved by the skate wheel with respect to a vertical position; and a flexible pad between the inner leg, of the U-shaped member and the bracket, wherein the flexible pad is compressed between the inner leg of the U-shaped member and the bracket when the skate wheel is moved away from a vertical position causing the training wheel to contact the brake pad.

14. A method of modifying an inline roller skate, said method comprising the steps of:

providing an inline roller skate having at least two skate wheels mounted in a straight line; and attaching a training device to the inline roller skate, the training device comprising a bracket for mounting onto the axle of at least one of the skate wheels;

a training wheel coupled to the bracket wherein the training wheel is spaced laterally from the skate wheels when the bracket is mounted onto the axle of at least one of the skate wheels; and a brake pad coupled to the bracket wherein the brake pad is spaced laterally from the skate wheels and above the training wheel;

wherein the training wheel and the brake pad are arranged such that the training wheel contacts an underlying ground surface without contacting the brake pad when the skate wheels are oriented at less than a predetermined angle relative to a vertical position, and wherein, when the skate wheel is moved to the predetermined angle relative to the vertical position by angular movement of the skate in use, the brake pad is selectively contacted by the training wheel while the training wheel and the bracket remain in a predetermined position relative to each other and while both the training wheel and the skate wheels are in contact with the underlying ground surface, so as to slow rotation of both the training wheels and the skate wheels while both the training wheel and the skate wheels remain in contact with the underlying ground surface.

15. The method of claim 14 wherein the training device is mounted to the axle of each of two skate wheels.

16. The method of claim 14 wherein the bracket comprises an elongated slot and including the step of horizontally adjusting the bracket to the axle of at least one of the skate wheels using the elongated slot.

17. The method of claim 14 wherein the bracket is mounted onto the axle of at least one of the skate wheels by a pin or bolt.

18. The method of claim 14 wherein the training device is attached inwardly of the inline roller skate.

19. The method of claim 14 wherein the training device is attached outwardly of the inline roller skate.

* * * * *

UNITED STATES PATENT AND TRADEMARK OFFICE

CERTIFICATE OF CORRECTION

PATENT NO. : 8,979,096 B2
APPLICATION NO. : 13/921601
DATED : March 17, 2015
INVENTOR(S) : Amir J. Tillis et al.

It is certified that error appears in the above-identified patent and that said Letters Patent is hereby corrected as shown below:

IN THE CLAIMS

CLAIM 9, column 6, line 56, delete “east” and substitute therefor -- least --;

CLAIM 9, column 6, line 57, delete “too”;

CLAIM 13, column 8, line 5, after “leg” delete “,”.

Signed and Sealed this
Thirtieth Day of June, 2015

Michelle K. Lee

Michelle K. Lee
*Director of the United States Patent and Trademark Office*